United States Patent [19]

Toland et al.

[11] 3,944,452

[45] Mar. 16, 1976

[54] ARTIFICIAL TURF PREPARATION

[75] Inventors: William G. Toland, San Rafael; Quentin T. Woods, San Jose, both of Calif.

[73] Assignee: Chevron Research Company, San Francisco, Calif.

[22] Filed: May 29, 1974

[21] Appl. No.: 474,458

[52] U.S. Cl. ..... 156/72; 28/72 NW; 156/435; 428/15; 428/85; 428/95; 428/97

[51] Int. Cl.[2] ..... B32B 5/02; D04H 11/00

[58] Field of Search ..... 156/72, 160, 161, 173, 156/231, 242, 247, 248, 427, 435, 574, 575, 577; 28/72 R, 72 P, 72 NW; 161/62, 66; 428/15, 85, 95, 97

[56] References Cited

UNITED STATES PATENTS

| | | | |
|---|---|---|---|
| 3,183,143 | 5/1965 | Harris | 156/296 |
| 3,332,828 | 7/1967 | Faria et al. | 156/72 |
| 3,444,017 | 5/1969 | Kleinermanns | 156/72 |
| 3,453,125 | 7/1969 | Williams | 106/19 |
| 3,477,889 | 11/1969 | Partensky | 156/72 |
| 3,674,525 | 7/1972 | Louthan | 106/19 |
| 3,676,166 | 7/1972 | Louthan | 106/241 |
| 3,723,213 | 3/1973 | Hoey | 156/435 |

*Primary Examiner*—Douglas J. Drummond
*Assistant Examiner*—John E. Kittle
*Attorney, Agent, or Firm*—G. F. Magdeburger; John Stoner, Jr.; T. G. De Jonghe

[57] ABSTRACT

A process for field preparation of a fibrous turf on a surface by steps including: (a) inserting fibers into a backing to obtain a backing with inserted fibers; (b) laying a receiving matrix on the surface; (c) bringing a portion of the backing with inserted fibers into connection with the receiving matrix so as to immerse the inserted fibers in the matrix; and (d) maintaining said portion of the backing stationary for a sufficient period of time so that the fibers will stay in the matrix upon removing the backing from the fibers.

Preferably the receiving matrix is a thermoplastic substance comprising sulfur, especially plasticized sulfur.

8 Claims, 6 Drawing Figures

ARTIFICIAL TURF PREPARATION

BACKGROUND OF THE INVENTION

The present invention relates to the preparation of artificial turf or carpeting in the field.

The term "turf" is used herein broadly to connote a preparation which is like carpet or shag rug or artificial grass.

The term "field" is used herein to connote preparation at the point of installation rather than preparation in a factory followed by transport to the point of installation.

Two exemplary patents relating to artificial turf which is prepared to simulate grass, although such preparation is carried out in a factory rather than in the field, are U.S. Pat. Nos. 1,939,846 and 3,332,828. The preparation method of U.S. Pat. No. 1,939,846 involves distributing fibrous material evenly over the top of a sheet of rubber composition and then vulcanizing the fibers to the sheet in a heat press. U.S. Pat. No. 3,332,828 relates to artificial turf preferably produced by weaving synthetic fibers on a Wilton cut-pile loom to form a structure consisting of a woven backing having a cut-pile face extending from one surface thereof and then applying a suitable latex formulation on the other surface of the backing to render the complete structure dimensionally stable.

SUMMARY OF THE INVENTION

According to the present invention, a process is provided which is suitable for field preparation of a fibrous turf on a surface, which process comprises:

a. inserting fibers into a backing to obtain a backing with inserted fibers;

b. laying a receiving matrix on the surface;

c. bringing a portion of the backing with inserted fibers into connection with the receiving matrix so as to immerse the inserted fibers in the matrix; and d. maintaining said portion of the backing stationary for a sufficient period of time so that the fibers will stay in the matrix upon removing the backing from the fibers.

It is to be understood that the term "backing" is used herein in a sense which includes a temporary transport belt or the like for the fibers, which thus is a generalized use of the term compared to textile terminology, wherein backing is a permanent part of a carpet.

Among other factors, the present invention is based on our conception and finding that field preparation of artificial turf can be successfully carried out by steps including laying a receiving matrix, placing fibers-in-backing on the receiving matrix so as to submerge the fibers at least partially into the matrix, and then removing the backing to leave the fibers implanted in the receiving matrix.

In general, the receiving matrix is a composition which is or becomes a solid at normal temperatures, i.e., below 180° F. However, during the turf-laying operation, the matrix must be a liquid, i.e., it must permit the insertion of the fibers. The usual way to obtain a liquid receiving matrix is to heat the matrix substance above its softening or melting point, generally in excess of 250° F. In this category are the thermoplastic substances, asphalt, plasticized sulfur, etc. In other instances, however, it is possible to have a receiving matrix that is liquid at normal temperatures, but is converted into a solid by chemical reaction. In this category are cement and the thermosetting substances — polyisocyanate-polyalcohol mixtures, styrene-polyester mixtures, etc. In both types, the solidified receiving matrix holds the yarn tufts firmly in position for future use.

It is advantageous to use a receiving matrix which is a thermoplastic substance, i.e., one which hardens upon cooling, and we have discovered that particularly preferred thermoplastic substances comprise plasticized sulfur.

When using a thermoplastic substance, preferably the fibers are immersed in the substance while it is molten, i.e., not yet completely solidified. Then the fibers are held by the backing in a stationary position for a sufficient period of time to allow the substance to solidify to an extent sufficient to retain fibers when the backing is removed from the fibers.

A particularly preferred thermoplastic substance is plasticized sulfur comprising sulfur, a sulfur plasticizing agent, glass fiber and a thixotropic agent. Inert fillers such as sand, carbon, and certain clays may also be added.

Plasticized sulfur usually has a lower melting point and a higher viscosity than elemental sulfur. Furthermore, plasticized sulfur requires a longer time to crystallize; i.e., the rate of crystallization of plasticized sulfur is slower than that of elemental sulfur. One useful way to measure the rate of crystallization is as follows: the test material (0.040 g) is melted on a microscope slide at 130° C. and is then covered with a square microscope slide cover slip. The slide is transferred to a hot-plate and is kept at a temperature of 78°±2° C., as measured on the glass slide using a surface pyrometer. One corner of the melt is seeded with a crystal of test material. The time required for complete crystallization is measured. Plasticized sulfur, then, is sulfur containing an additive which increases the crystallization time within experimental error, i.e., the average crystallization time of the plasticized sulfur is greater than the average crystallization time of the elemental sulfur feedstock. For the present application, plasticizers are those substances which, when added to molten, elemental sulfur, cause an increase in crystallization time in reference to the elemental sulfur itself. In one set of experiments, elemental sulfur required 0.44 minute to crystallize under the above conditions, whereas sulfur containing 3.8% of a phenol-sulfur adduct (as described in U.S. Pat. No. 3,892,686 required 2.9 minutes. Sulfur containing 6.6% and 9.9% of the same phenol-sulfur adduct required 5.7 and 22 minutes, respectively.

Inorganic plasticizers include iron, arsenic and phosphorus sulfides, but the particularly preferred plasticizers are organic compounds which can react with sulfur to give sulfur-containing materials, such as styrene, alphamethylstyrene, dicyclopentadiene, vinyl cyclohexene, the aromatic compound-sulfur adducts of Ser. No. 344,694 as well as the aromatic compounds used to produce these adducts, liquid polysulfides (e.g., those sold under the trade name of Thiokol LP-3 or LP-32), and the viscosity control agents described in U.S. Pat. Nos. 3,674,525, 3,453,125 and 3,676,166. The preferred aromatic plasticizing compounds are styrene and the phenolsulfur adduct of U.S. Pat. No. 3,892,686. The preferred aliphatic compound is dicyclopentadiene.

One preferred thermoplastic substance contains dicyclopentadiene, sulfur, glass fiber and talc.

The elemental sulfur may be either crystalline or amorphous and may contain small amounts of impurities such as those normally found in commercial grades of sulfur. Optimum proportions of sulfur, as well as of the other components of the composition may vary considerably. However, proportions of sulfur of about 73 to 97%, by weight, are generally satisfactory.

Dicyclopentadiene is readily available commercially, generally at a purity of about 96% or greater. Preferably it is used in the above preferred plasticized sulfur composition in an amount of about 1 to 7% by weight.

The glass fiber of the preferred plasticized sulfur composition is preferably employed in the form of milled fibers, with the fibers generally ranging from about one thirty-second to one-eighth inch in length, preferably with an average length of about one-sixteenth inch. These fibers, which generally consist of high-silica glass, are readily available commercially, often coated with a starch binder. The type of glass is, however, not critical, as long as it provides the resulting composition with adequate shear strength, preferably a shear strength of about 400 to 800 psi. The glass fiber preferably constitutes about 1 to 5% by weight of the composition of the invention.

The talc used in the preferred dicyclopentadienesulfur-glass fiber-talc composition preferably is a foliated type, or a compact variety such as steatite. Impure varieties such as soapstone can also be used. This ingredient is preferably used in an amount of about 1 to 15% by weight of the composition, and serves the dual function of providing thixotropy to the mixture and of dispersing the glass fiber throughout the composition, thereby preventing agglomeration of the fibers.

The preferred composition is used as a fluid mixture of the ingredients, with the sulfur and dicyclopentadiene in molten form and the glass fiber and talc distributed throughout the molten material. Thus the composition is prepared by homogeneous mixing of the ingredients at elevated temperature sufficient to maintain the sulfur and dicyclopentadiene in a molten state. A temperature of about 240° to 320° F. is satisfactory, with about 275° to 320° F. being preferred. Any conventional vessel or reactor capable of providing the required temperature and mixing means may be used for preparation of the composition.

Thermosetting receiving matrices are useful in situations where it is difficult to lay down a hot thermoplastic layer, or where the properties of the thermosetting substances are desired, e.g., a rubbery or resilient polyurethane base. Asphalt is generally a thermoplastic receiving matrix, but it can be used in the form of an asphalt emulsion which is applied cold in the liquid form, but soon develops into a solid asphalt layer with concurrent water separation.

The term "thixotropic agent" is used herein to mean a material which lends itself to low viscosity at high shear (high mixing or stirring rate) for the sulfur mixture containing the agent, but which helps cause the sulfur mixture to have high viscosity at low shear, so that the mixture will readily set up as a non-runny, non-drippy coating or layer upon application to a surface. The plasticized sulfur matrix is applied at temperatures above molten sulfur temperature, that is, above about 248° F., and preferably at a temperature between 250° and 300° F.

In the present invention, fibers-in-backing are placed fiber-side-down on the receiving matrix and then the backing is removed to leave the fibers implanted in the receiving matrix. The backing can be removed by various means, such as simply by lifting it from the implanted fibers manually or mechanically, or by cutting the backing free from the fibers. Preferably the backing is a continuous belt, i.e., like a conveyor belt, receiving fibers as in input and implanting fibers in the receiving matrix as an output from the belt.

Thus, according to a preferred embodiment of the present invention, a process is provided which comprises:

a. inserting fibers into a continuous rotatable belt adapted to have fibers inserted;

b. bringing the belt into connection with and immersing said fibers into a receiving matrix, preferably a thermoplastic substance;

c. holding the belt stationary, e.g., maintaining a zero relative belt velocity to the ground, so as to keep the fibers immersed in the receiving matrix for a sufficient period of time so that fibers will stay in the matrix upon removing the backing from the fibers; and d. releasing the belt from connection with the receiving matrix.

Preferably, in the above embodiment the fibers inserted as per step (a) are "continuous" fibers. A further step is included before step (b), namely, cutting the inserted continuous fibers to a length suitable for implantation into the receiving matrix to obtain fibrous turf. As the fibers or strands can be looped or straight, suitable lengths to which the fiber is cut are from about 1 to 2 times the normal length of carpeting or turf surfaces; thus, from about ⅛ to 4 inches, and more usually from about ½ to 1 inches.

The term continuous fiber is used herein to indicate long fibers, for example, fibers wound on a bobbin. Since the long fibers are finite, the term continuous is used only in a figurative sense to indicate that the fiber fed into the belt in this preferred embodiment is much longer than the cut fiber which is ultimately implanted in the receiving matrix.

The term "fiber" is used herein to include monofilament strands as well as polyfilament strands (yarns and threads and yarns made by twisting a fibrillated thermoplastic tape). Preferably yarn is used for inserting into the backing or backing belt and in turn into the receiving matrix. The yarn can be produced by twisting filaments together by methods known in the carpet-producing art. In this regard, see, for example, U.S. Pat. No. 3,422,615. Materials which can be used as the monofilament strands or as the polyfilament strands, that is, yarns, include synthetic plastic materials as well as animal-derived materials such as wool. Preferably, synthetic materials are used, i.e., synthetic plastic materials capable of being formed into filaments and yarns, for example by extruding into a pellicle and then cut or shredded into filaments which can in turn be converted to yarns. Polypropylene is a particularly preferred synthetic plastic material for forming fibers for use herein, and a particularly preferred polypropylene yarn is made by twisting fibrillated polypropylene tapes. Other materials which can be used include other polyolefins, polyethylene terephthalate, polyacrylonitrile, viscose rayon, cellulose acetate, nylon, polyvinyl chloride, and fibrous glass.

In addition to U.S. Pat. No. 3,422,615, U.S. Pat. Nos. 3,177,557, 3,242,035 and 3,332,828 disclose materials which can be used to produce monofilament strands as well as polyfilament strands (yarns) for making artificial turf.

DRAWINGS

The drawings (FIGS. 1-6) are schematic diagrams illustrating preferred embodiments of the present invention.

FURTHER DESCRIPTION AND EXAMPLES

Referring in more detail to the drawings, as shown in FIG. 1, the thermal-setting substance is passed from tank or container 6 onto the surface or ground. The thickness laid on the surface is preferably about ¼ to 1 inch, and the material preferably is molten, plasticized sulfur.

Yarn-inserting assembly 4 inserts fibrous material such as yarn or monofilament strands into belt 3, which preferably is a steel transport belt having perforations. The fibrous material can be inserted into the belt, which acts as a backing, using conventional tufting techniques. Thus the fiber material can be fed into the belt off one but preferably numerous bobbins using conventional carpet-tufting techniques, which include the use of a needle frame containing a plurality of needles to stitch the fiber material or yarn into the belt backing. Preferably the yarn is tufted into the backing in a C-shape, such as shown by FIG. 1 and in more detail in FIG. 2, as indicated by 7 and 7A. The loops can be extracted by yarn-extracting assembly 5 to form a single strand, such as indicated by 8 and 8A in FIGS. 1 and 3.

The single strand is then only loosely held in the belt by friction and can be deposited into thermoplastic matrix 10 by immersing the strands in the receiving matrix and holding them there for a sufficient period of time to allow the receiving matrix to solidify sufficiently to retain fibers upon removing the backing from the fibers.

As shown in the schematic preferred embodiment, the belt is lowered using horizontal rollers 11 and 11A, moving in the direction indicated by arrows 12 and 12A, so that the strands are immersed in the receiving matrix. The belt is removed from "connection" with the receiving matrix by raising rollers 11 and 11A, as indicated by arrows 13 and 13A, thus allowing or causing the belt to rise upwardly and leaving the loosely held fibers imbedded in the receiving matrix. The term connection is used in the sense that the fibers in the belt backing are immersed in the receiving matrix and thus form a link or connection between the belt and the receiving matrix.

To increase the speed of solidification or thermal setting of the receiving matrix, a cooling operation can be used, as indicated by spray nozzle 14.

After the belt has been allowed to rise upwardly as indicated by arrows 13 and 13A, the belt is moved forward by large rollers 15 and 15A, traveling in the direction as indicated by arrows 16 and 16A. In general, the entire apparatus can be mounted onto a moving vehicle, moving in the direction indicated by arrow 17.

Although the yarn flow or insertion into the backing by yarn-inserting assembly 4 into belt 3 is a conventional-type tufting function, the carpet backing or belt in this instance serves as a conveyor to receive the oriented and cut strands from the tufting frame and transport this strand pattern such that it can be deposited into the molten and receptive thermoplastic substance.

Rather than employing woven or fabric backing, as is the normal practice in carpet tufting, preferably a perforated steel belt is used. The hole pattern in the preferred thin steel belt preferably is consistent and congruent to the center-to-center needle spacing on the needle frame used for the tufting operation. Thus, at point 7 in the process, as schematically indicated in FIG. 1, a tufted cut-pile carpet has been produced that employs a continuous belt backing, preferably a stainless steel backing in place of a conventional fabric backing.

The individual stitched or tufted strands are held in the backing by friction or, more accurately, impaled by a press-fit condition of the strands protruding through the belt backing holes.

Preferably the belt is a stainless steel belt of approximately 0.030 inch thickness, having tuft holes that are slightly less than two polypropylene strands or yarns in diameter.

As illustrated in FIG. 2, each individual tufted strand, as indicated by 7A, as impaled in the backing belt resembles a staple with two legs of length L protruding through one side of the backing with a cross bar of length C connecting these two legs on the other side of the backing.

Also shown in FIG. 3 is this same strand of total length 2L+C with one leg picked out of the backing such that a length of strand L protrudes from one side of the backing belt and a length of L+C of the same strand is sticking out of the other side of the backing belt. The length L, or some part thereof, preferably is immersed in the receiving matrix.

A stripping arbor, as indicated by 18 in FIG. 1, performs a stripping or "pick-out" function that converts the individual strands from a staple shape into that of a straight strand whose axis is about 90° to the backing belt surface.

Instead of stripping, the closed portion of the U-shaped strand can be cut to provide fibers which can be extracted from the belt upon immersing the strand in the mastic and retention of the strand in the mastic.

The strands can be conveyed into Section 19 for lowering into connection with thermoplastic substance 10 by lowering rollers 11 and 11A in the direction of arrows 12 and 12A. The belt is held in a stationary position with the strands immersed in the receiving matrix for a sufficient length of time to allow thermal setting, so that the receiving matrix will retain fibers upon raising rollers 11 and 11A in the direction indicated by arrows 13 and 13A. Then the apparatus can be moved on and the process continued, so that another section of turf can be made, leaving behind finished turf, as indicated by 20 in FIG. 1.

Although the process can be operated batchwise as described, preferably the process is carried out continuously. In the continuous operation, rollers 11 and 11A keep the continuous belt 3 in connection with the mastic so that the belt operates similar to a tank tread. That is, as the belt comes into connection with the mastic and the fibers in a given section of the belt are submerged in the mastic, the speed of that given section of the belt relative to the ground becomes zero, even though the apparatus as a whole continues to move forward in the direction indicated by arrow 17. The speed of the apparatus can be adjusted to allow sufficient time, and/or cooling water spray as indicated by 14 can be used to cool the mastic, so that the mastic retains the submerged fibers when the given section of the belt is lifted from the mastic as the given section starts traveling upward upon reaching roller 11.

Thus, in accordance with a preferred method for carrying out the present invention, an apparatus, e.g., as schematically indicated in FIG. 1, is mounted on a wheeled vehicle that is either towed or self-propelled by a suitable drive system. The speed of the belt, as driven by the drive wheels, is equal to the ground speed of the vehicle. With this matched-speed arrangement, the belt moving aft, at the time of the strand insertion, has a velocity of zero relative to the ground.

This is analogous to that of a tracked vehicle or tractor, where the driven track also has a zero velocity relative to the ground as the vehicle is propelled by this track.

That span of horizontal belt between the tangent points of rollers 11 and 11A having zero relative velocity to the mastic provides a time span during which the mastic will solidify and create adhesion.

FIG. 4 illustrates a preferred embodiment of the present invention wherein uncut end loops of fiber are imbedded in a receiving matrix. The belt or backing can be withdrawn, leaving the fibers. Then the backing can be reused as in a continuous process as illustrated in FIG. 1, or in another mode wherein the backing is reused.

Figure 2:
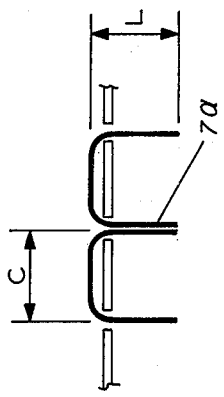
Figure 3:
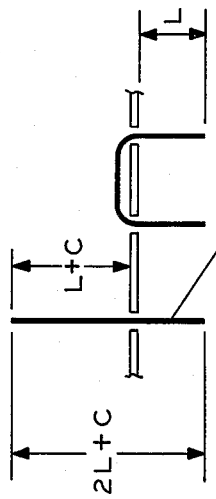
Figure 1:
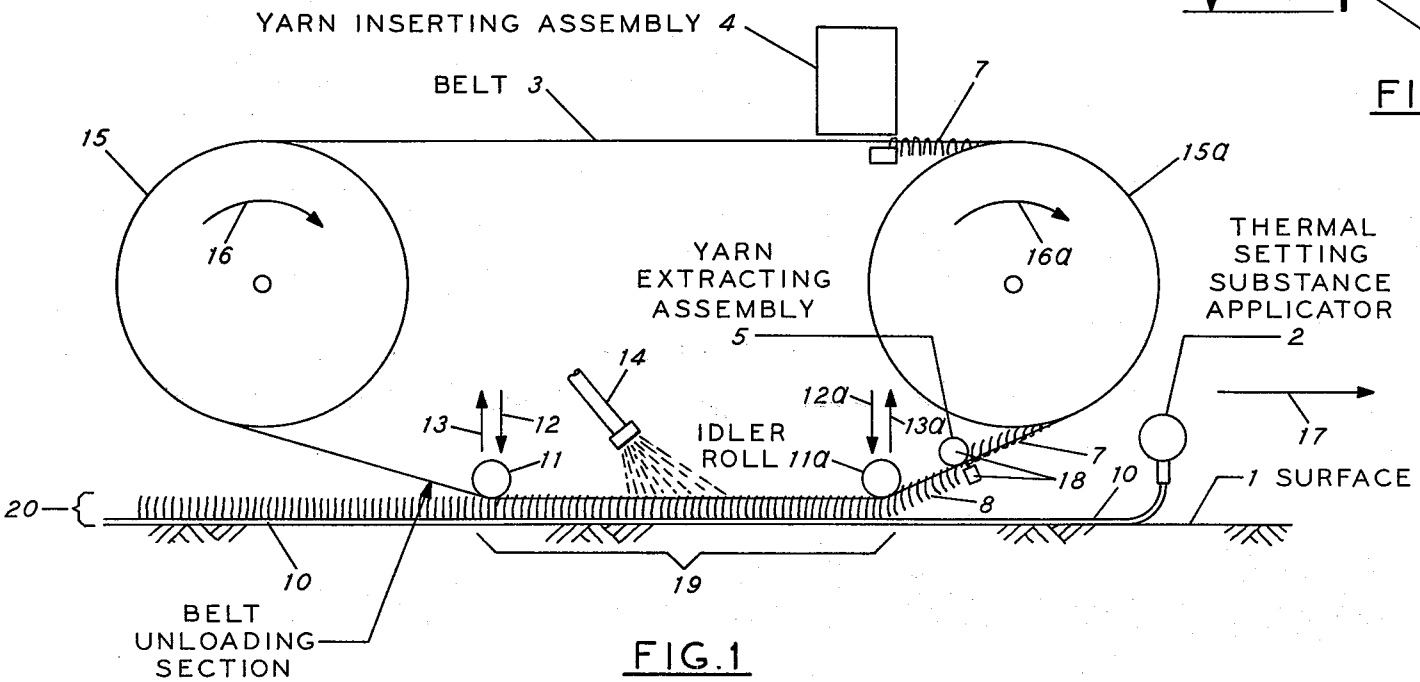
Figure 4:
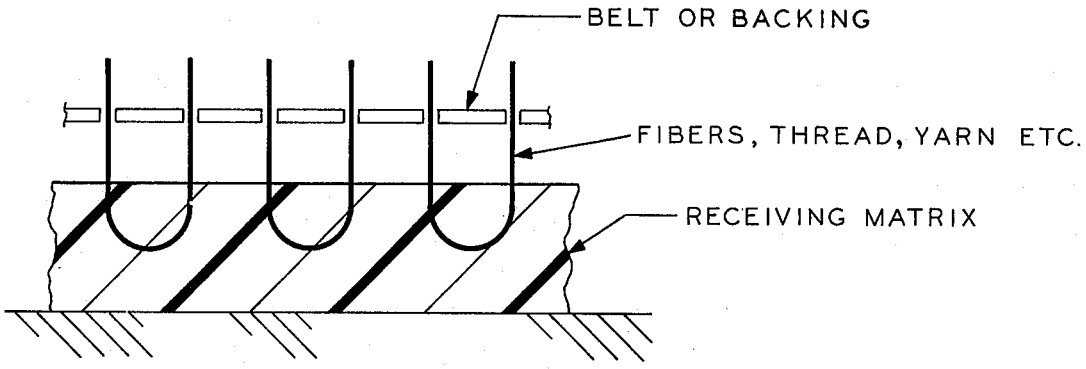
Figure 5:
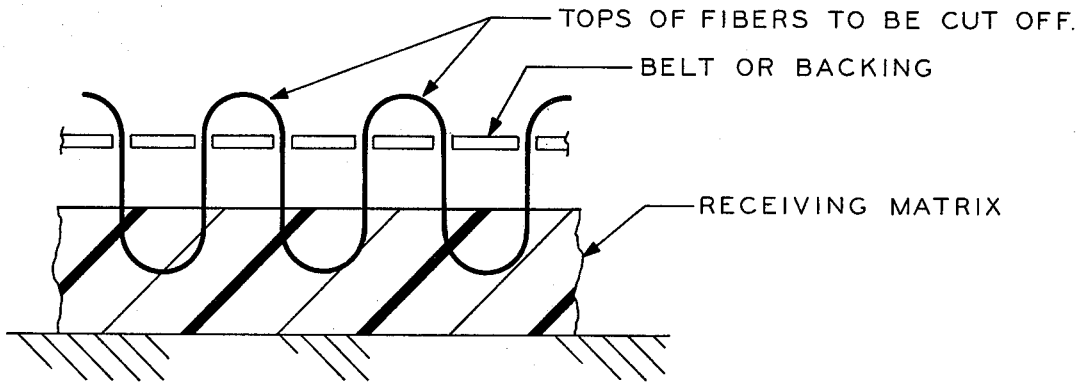
FIG. 5 illustrates a preferred embodiment wherein the tops of the fiber loops need to be cut before the backing can be reused.
Figure 6:
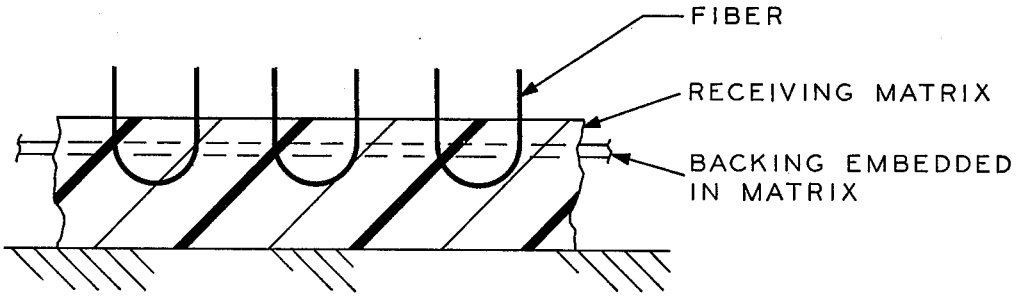
FIG. 6 illustrates implantation of the backing in the matrix. Preferably the backing is withdrawn before solidification of the matrix so that the backing can be used in accordance with the usual concept of the present invention.

In accordance with an alternate mode of operation, the backing is left permanently imbedded in the matrix. This alternative is attractive in the case of inexpensive backings, particularly in conjunction with the plasticized sulfur compositions disclosed herein.

EXAMPLES

EXAMPLE 1—Plasticized Sulfur Mastic as a Carpet Base

A plasticized sulfur mastic was prepared by heating a mixture of 3 parts of dicyclopentadiene and 100 parts of molten sulfur until there was a noticeable increase in viscosity. Next, 10 parts of talc and 3 parts of glass fiber (milled to one-eighth inch lengths) were added and the whole mixture was stirred until it was homogenous. This material was then poured onto a flat 12 inch × 18 inch area of ground covered with small-sized gravel to a depth of three-eighth inch. Before the sulfur mastic hardened, a sheared or cut-pile indoor-outdoor carpet, made by tufting polypropylene yarn into a polypropylene primary backing and without any latex or other secondary backing, was laid on the mastic. When the mastic had hardened, a corner of the backing was pried loose, and then the entire backing was pulled upward, through the cut piles, leaving the tufts securely anchored in the smooth, hard mastic surface. The finished installation had the appearance of a grassy lawn.

EXAMPLE 2—Non-Plasticized Sulfur Mastic as a Carpet Base a. A small (4 inch × 4 inch) piece of polypropylene tufted indoor-outdoor carpet was immersed upside down (about one-quarter inch) into a molten sulfur-glass fiber mixture one-half inch deep. When the sulfur had hardened, the carpet backing was cut off, leaving a grass-like structure held in place by the solidified sulfurglass fiber mixture.

b. The same experiment was repeated except that the glass fibers were replaced by sand. The results were the same.

The above experiment indicates that sulfur, with or without an added material such as talc or sand or glass fiber, can be used in the present invention instead of plasticized sulfur.

However, our other experimental work indicates that plasticized sulfur performs better in the present invention.

What is claimed is:

1. A process for continuous field preparation of a fibrous turf on the ground using a wheeled vehicle which is moved forward at a ground speed and which has a continuous rotatable belt operably connected to the vehicle, which process comprises:

a. inserting fibers into the continuous rotatable belt, the belt being adapted to have fibers inserted therein, to obtain a belt with inserted fibers;

b. laying a receiving matrix on the ground;

c. bringing a portion of the belt with inserted fibers into connection with the receiving matrix as the vehicle moves forward so as to immerse the inserted fibers in the matrix;

d. operating the belt member of the moving vehicle similar to a tank tread; and e. maintaining said portion of the belt in zero relative velocity to the ground, by rotating the belt by drive wheels at a speed equal to the ground speed of said vehicle, for a sufficient period of time so that the fibers will stay in the matrix upon removing the backing from the fibers.

2. A process in accordance with claim 1 wherein the receiving matrix is a thermoplastic substance.

3. A process in accordance with claim 2 wherein the thermoplastic substance comprises plasticized sulfur.

4. A process in accordance with claim 3 wherein the plasticized sulfur comprises sulfur, a sulfur plasticizing agent, glass fiber and a thixotropic agent.

5. A process in accordance with claim 4 wherein the plasticized sulfur also contains an inert filler.

6. A process in accordance with claim 3 wherein the plasticized sulfur comprises, by weight, about 65 to 97% sulfur, about 1 to 7% dicyclopentadiene, about 1 to 5% glass fiber, and about 1 to 15% talc.

7. A process in accordance with claim 2 wherein the fibers inserted as per step (a) are continuous fibers and wherein prior to step (c) the fibers are cut to a length suitable for implantation into the thermoplastic substance to obtain a fibrous turf.

8. A process in accordance with claim 7 wherein the thermoplastic substance is plasticized sulfur comprising sulfur, a sulfur plasticizing agent, glass fiber, and a thixotropic agent.

* * * * *